US008814310B2

(12) United States Patent
Hayashi

(10) Patent No.: US 8,814,310 B2
(45) Date of Patent: Aug. 26, 2014

(54) PRINTER

(75) Inventor: Toru Hayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 97 days.

(21) Appl. No.: 13/362,638

(22) Filed: Jan. 31, 2012

(65) Prior Publication Data

US 2012/0194589 A1 Aug. 2, 2012

(30) Foreign Application Priority Data

Jan. 31, 2011 (JP) ..... 2011-017633

(51) Int. Cl.
*B41J 29/38* (2006.01)
*B41J 13/02* (2006.01)
*B41J 15/16* (2006.01)

(52) U.S. Cl.
CPC ..... *B41J 15/16* (2013.01); *B41J 13/025* (2013.01)
USPC ..... 347/16; 347/104; 347/218

(58) Field of Classification Search
CPC ..... B41J 13/025
USPC ..... 347/14
See application file for complete search history.

(56) References Cited

U.S. PATENT DOCUMENTS 5,743,663 A 4/1998 Imai
2005/0212890 A1 * 9/2005 Kitamura et al. ..... 347/171
2009/0313826 A1 * 12/2009 Mita ..... 29/890.1

FOREIGN PATENT DOCUMENTS

JP 2004-098696 A 4/2004
JP 2004-098698 A 4/2004

* cited by examiner

*Primary Examiner* — Manish S Shah
*Assistant Examiner* — Jeffrey C Morgan
(74) *Attorney, Agent, or Firm* — Global IP Counselors, LLP

(57) ABSTRACT

A printer includes a head for performing printing, a roll element on which a print medium is wound, a first conveying mechanism for rotating the roll element, an auxiliary roller positioned between the head and the roll, a second conveying mechanism for driving the auxiliary roller, a nip roller constituting a pair with the auxiliary roller to hold the medium on both sides, a nip roller drive mechanism for driving the nip roller and creating a state in which the medium is held on both sides and a state in which the medium is not held on both sides, and a controller for setting the nip roller to a first state in which the roll element is rotated in a forward direction to convey the print medium, and a second state in which the roll element is rotated in a reverse direction to convey the print medium.

5 Claims, 2 Drawing Sheets

PRINTER

CROSS-REFERENCE TO RELATED APPLICATIONS

This application claims priority to Japanese Patent Application No. 2011-017633 filed on Jan. 31, 2011. The entire disclosure of Japanese Patent Application No. 2011-017633 is hereby incorporated herein by reference.

BACKGROUND

1. Technological Field

The present invention relates to a printer in which a print medium is conveyed using a roller.

2. Background Technology

Technology for conveying a print medium using a nip state in which the print medium is held on both sides by a plurality of rollers is known. For example, there is disclosed in Patent Citation 1 a paper-feeding roller and a conveying roller for holding a print medium on both sides and conveying the medium using two rollers.

Japanese Laid-open Patent Publication No. 2004-98698 (Patent Document 1) is an example of the related art.

SUMMARY

Problems to be Solved by the Invention

In well-known technology, printing at high speeds cannot be performed in inkjet printers and other printers in which ink or another colorant must be fixed to a print medium after the colorant is recorded on the print medium. Specifically, a predetermined time period is required for the colorant to dry in the case of a configuration in which the colorant is air-dried or dried by a heater or the like in order to be fixed to the print medium, and the colorant is transferred to the rollers when the print medium is held on both sides and conveyed by two rollers before the predetermined time period has elapsed. In particular, printing must be repeated a plurality of times in a configuration in which printing is performed once on the print medium and then performed again after the print medium has been conveyed in a reverse direction along a conveying route. Printing cannot therefore proceed at high speeds if a predetermined standby period is necessary before printing is performed a second time. The invention was devised in view of the problems described above, and an object thereof is to perform printing at high speeds in a printer in which a colorant must be fixed to a print medium.

Means Used to Solve the Above-Mentioned Problems

In order to achieve the above-mentioned object, the printer in the invention includes a first conveying mechanism for conveying a print medium using a nip state, and a second conveying mechanism for conveying the print medium farthest upstream on a conveying route, wherein the first conveying mechanism is set to a nip-release state, and the print medium is conveyed by the second conveying mechanism in a case in which the print medium for which the predetermined time period has not yet elapsed is conveyed after printing. Specifically, the printer is configured so that, in a state in which the predetermined time period has not elapsed after printing and a printed colorant can be transferred to a roller of the first conveying mechanism, the nip-release state is set and the print medium is conveyed by the second conveying mechanism in which colorant is not transferred because the mechanism is disposed farthest upstream. The print medium can thereby be conveyed even in a state in which the colorant is not completely fixed to the print medium, and printing can be performed at high speeds in a printer in which the colorant must be fixed to the print medium.

The first conveying mechanism can be designed so as to be able to implement a nip state in which the print medium is held on both sides by a plurality of rollers, and a nip-release state in which the print medium is not held on both sides by the plurality of rollers; and to be able to convey the print medium using the nip state. Specifically, the mechanism is configured so that pressure is applied to the print surface of the print medium from the rollers in the nip state, and the print medium is conveyed in a direction tangential to the point of contact between the circumference of the rollers and the print medium at the cross section of the rollers by the rotation of at least one roller in the nip state. In addition, the mechanism is configured so that a condition is established in the nip-release state that the pressure (pressure in the direction perpendicular to the aforementioned tangent) on the print surface of the print medium from the rollers is suppressed or absent, and the colorant is not transferred onto the rollers even in a case in which the unfixed colorant is present on the print surface of the print medium. The nip state and the nip-release state can be implemented by varying or otherwise altering the position of the rollers using an actuator. The actuator can be driven by a motor, or by a hydraulic mechanism or the like, and various configurations can be adopted. Furthermore, at least two rollers should be present, but three or more can also be present.

The second conveying mechanism can be a mechanism disposed farthest upstream on the conveying route and used for conveying the print medium, a mechanism for paying out the print medium accumulated in a roll shape by rotating the rollers or for conveying the print medium by winding up the print medium, or a mechanism for holding the print medium on both sides with a plurality of rollers and conveying the print medium by rotating the rollers, as in the first conveying mechanism. Specifically, any type of second conveying mechanism can be adopted because the mechanism is disposed farthest upstream on the conveying route.

A conveyance controller can be configured so that the print medium can be conveyed in accordance with the timing for printing on the print medium, and that, in a case in which the print medium for which the predetermined time period has not yet elapsed is conveyed after printing, the first conveying mechanism is set to the nip-release state, and the print medium is conveyed by the second conveying mechanism. The predetermined time period is the time period from the time the colorant is printed onto the print medium until the time the colorant is fixed on the medium, and the elapsed time after printing can or can not be measured every time printing is performed. Specifically, there is no need to measure the time elapsed after printing every time printing is performed if it is confirmed in the design step that the printed section on the print medium clearly contains a section for which the predetermined time period has not yet elapsed after printing as a result of the print medium being conveyed in a predetermined sequence after printing, and that the section can clearly reach the space between the rollers of the first conveying mechanism.

In an inkjet printer for discharging ink as a colorant from a print head, a configuration is sometimes adopted in which the ink is dried and fixed to a print medium by a heater disposed parallel to the conveying route farther downstream on the conveying route than the print head. The predetermined time period is the time period before the ink printed on the print medium is dried by the heater in a case in which the printer is configured so that the print medium is conveyed in the reverse direction and returned upstream of the print head to repeat the printing in a step in which the ink is dried by the heater.

Furthermore, the printer can have a configuration in which a larger amount of pressure is applied to the print surface of the print medium in the nip state in the first conveying mechanism than in a case in which the print medium is conveyed by the second conveying mechanism, and can be configured so that the first conveying mechanism is set to the nip-release state and the print medium is conveyed by the second conveying mechanism in a case in which the print medium for which the predetermined time period has not yet elapsed is conveyed after the printing of the colorant. Specifically, the unfixed colorant can be transferred in the nip state in the first conveying mechanism due to the application of a comparatively large amount of pressure to the print surface. However, in a state in which there is no transfer of the unfixed colorant due to the application of a comparatively small amount of pressure to the print surface in a case in which the print medium is conveyed by the second conveying mechanism, the first conveying mechanism is set to the nip-release state in order to prevent the transfer of the colorant in a case in which the print medium for which the predetermined time period has not yet elapsed is conveyed. A configuration in which the second conveying mechanism is a mechanism that conveys the print medium by rotating the rollers to pay out the print medium accumulated in a roll shape or to wind up the print medium can be given as an example of a configuration in which a larger amount of pressure is applied to the print surface of the print medium in the nip state in the first conveying mechanism than in a case in which the print medium is conveyed by the second conveying mechanism.

Furthermore, the invention can be applied to a configuration in which printing is performed a plurality of times on a print medium using a shared print head by reversing the print head along the conveying route. For example, in a configuration in which the first conveying mechanism is disposed farther upstream on the conveying route than the print head and farther downstream on the conveying route than the second conveying mechanism, white ink is discharged by the print head and first printing is performed on the print medium while the print medium is conveyed downstream by the second conveying mechanism and the first conveying mechanism in the nip state. The first conveying mechanism is then set to the nip-release state, and the print medium is conveyed upstream by the second conveying mechanism. According to this configuration, after the first printing is performed, the print medium can be returned to a position at which printing can be implemented a second time while the white ink is prevented from being transferred onto the rollers of the first conveying mechanism.

Color ink is discharged by the print head and second printing is performed on the print medium while the print medium is again conveyed downstream by the second conveying mechanism and the first conveying mechanism in the nip state, whereby a printing result in which an image is rendered using color ink on a white background can be obtained. The aforementioned configuration is one in which white ink is printed in a predetermined area on a print medium to form an area where an image is rendered, and in which the printing is repeated in the area to render a multicolored image. This configuration can, for example, be applied to a case in which an image is formed on print medium in the form of a transparent film.

Furthermore, as a preferred example of a case in which reprinting is performed, a configuration can be envisaged in which the print start position on the print medium is identified and printing is performed based on the reference position on the print medium detected by a reference position detection sensor. In a specific configuration, a match can be established in the first printing and the second printing for the relationship between the reference position on the print medium detected by the reference position detection sensor and the print start position on the print medium. Specifically, the print medium is reversed and conveyed upstream along the conveying route after the first printing, but setting the first conveying mechanism in this case to the nip-release state produces a state in which it is difficult for the actual amount of conveyance of the print medium to accurately follow the predetermined amount of conveyance of the print medium by the conveying mechanism. In view of this, the print start position in the first printing is identified based on the reference position on the print medium, and the print start position in the second printing is also identified based on the reference position on the print medium, making it possible to prevent a discrepancy in the print position between the first printing and the second printing when performing printing, and to perform printing at a high quality.

Here, the reference position detection sensor can identify the relationship between the reference position on the print medium and any position on the print medium by detecting the reference position on the print medium, and the print start position at which printing starts in the first printing can be identified according to this configuration. Specifically, if printing is started at a stage in which the reference position (position or other point at which an end part of the medium or a reference mark is recorded) on the print medium is detected by the reference position detection sensor, then the print start position is the end part of the area in which printing is performed by the print head at a stage in which the reference position on the print medium is detected by the reference position detection sensor. In addition, if printing is started at a stage in which the print medium is conveyed a predetermined amount after the reference position on the print medium is detected by the reference position detection sensor, then the print start position is the end part of the area in which printing is performed by the print head at a stage in which the print medium is conveyed a predetermined amount after the reference position on the print medium is detected by the reference position detection sensor. Accordingly, if the print start position is identified based on the reference position on the print medium in the first printing, then the print start position is the position having the same relationship relative to the reference position on the print medium in the second printing. Reprinting can thereby be performed in an accurate print area in the second printing.

Such a printer can also be devised as a method invention in which the first conveying mechanism is set to a nip-release state in a case in which the print medium for which the predetermined time period has not yet elapsed is conveyed after printing, or as a program invention for conveyance control. Such an apparatus, program, and method can be implemented as a single apparatus, or can be implemented using shared components in an apparatus having complex functions, and can include various embodiments.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the invention is described in the following order:

(1) Configuration of Inkjet Printer:

(2) Printing Process:

(3) Other Embodiments:

(1) Configuration of Inkjet Printer

Figure 1A:
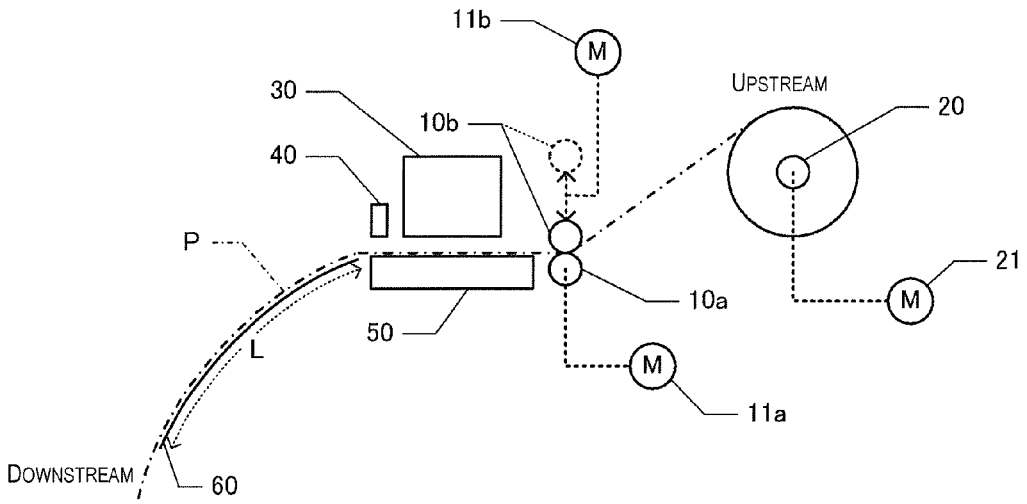
FIG. 1A is a view schematically showing the configuration of an inkjet printer according to an embodiment of the invention.
Figure 1B:
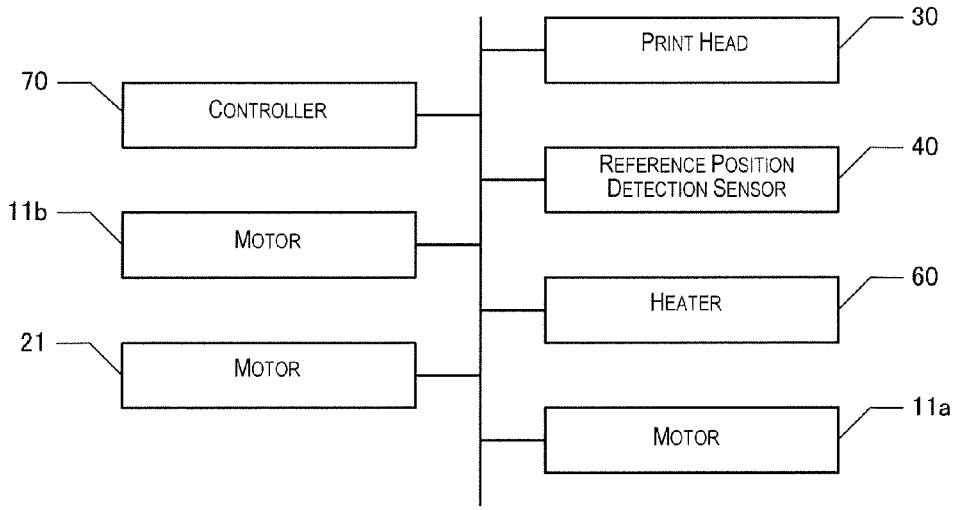
FIG. 1B is a view showing a controller provided to the inkjet printer, and hardware controlled by the controller.

FIG. 1A is a view schematically showing the configuration of an inkjet printer according to an embodiment of the invention, and FIG. 1B is a view showing a controller provided to the inkjet printer, and hardware controlled by the controller. In the inkjet printer according to the present embodiment, an ink-discharging print head 30 is provided, a print medium P shown by the dashed-dotted line in FIG. 1A is conveyed over a platen 50, a reference mark (a plus sign or the like) on the print medium is detected by a reference position detection sensor 40, a print start position is established, and ink is discharged from the print head 30 to perform printing.

In the present embodiment, the print head 30 is a head capable of discharging white and multicolored solvent ink, and capable of printing a desired color image on a print medium P comprising a transparent film by printing white ink on the transparent film, and then printing color ink on the area printed with white ink, which serves as the print area. Printing is performed while the print medium P accumulated on a below-described roller element 20 is conveyed downstream, made to travel between the print head 30 and the platen 50, and further conveyed downstream away from the print head 30.

Solvent ink printed on film-type material is generally difficult to dry in this case, and the inkjet printer in the present embodiment is therefore provided with a heater 60 disposed downstream of the print head 30 and the platen 50. The heater 60 is provided with a tabular thermal radiator having a curved surface, and the curved surface is disposed along the conveying route of the print medium P so as to be parallel with the conveying route. The curved surface of the heater 60 in the present embodiment is designed to have a predetermined length L along the conveying route of the print medium P, as shown by the arrows on the broken line in FIG. 1. Specifically, the predetermined length L is designed so that the ink is dried by passing the printed section through the range of the predetermined length L in a case in which printing is continued in a state in which the print medium P on which printing was performed by the print head 30 is warmed by the heater 60 while being conveyed at a predetermined conveying speed. In the present embodiment, the time required for the print medium P to pass through the range of the predetermined length L at the predetermined conveying speed is assumed to be the predetermined time required for the ink to dry in a case in which the print medium P is conveyed at the predetermined speed while being printed on by the print head 30.

In the present embodiment, once the white ink is printed on the print medium P by the print head 30, the print medium P is then reversed and conveyed along the conveying route, and the color ink is again printed on the print medium P. Accordingly, the mechanism for conveying the print medium P in the present embodiment can convey the print medium P along the conveying route from upstream to downstream, and can convey the print medium P in reverse along the conveying route from downstream to upstream.

The mechanism for conveying the print medium P in the present embodiment includes a conveying mechanism for holding the print medium on both sides and conveying the medium using an auxiliary roller 10*a* and a nip roller 10*b*, and a conveying mechanism for winding up the print medium P on the roller element 20 to accumulate the medium in a roll shape, and rotating the roller element 20 to further convey the print medium P.

The roller element 20 in the present embodiment doubles as an accumulator for the print medium P and conveys the print medium P along the conveying route by paying out the print medium P accumulated on the roller element 20, for which reason the roller element 20 is positioned farthest upstream on the conveying route of the print medium P. In addition, a first drive mechanism 21 is connected to the roller element 20, and the print medium P accumulated in a roll shape can be paid out or wound up by rotating the first drive mechanism 21 in a predetermined direction or in a direction opposite to the predetermined direction. In the present embodiment, the roller element 20 and the first drive mechanism 21 thus correspond to a second conveying mechanism for conveying the print medium P farthest upstream on the conveying route.

The auxiliary roller 10*a* and the nip roller 10*b* are positioned farther upstream on the conveying route than the print head 30 and farther downstream on the conveying route than the second conveying mechanism, and the rotational axes of the auxiliary roller 10*a* and the nip roller 10*b* are disposed parallel to each other. In the present embodiment, the position of the auxiliary roller 10*a* is fixed and the roller is supported in the inkjet printer so as to be able to rotate about the rotational axis. A second drive mechanism 11*a* is connected to the auxiliary roller 10*a*, and the auxiliary roller 10*a* can be rotated in a predetermined direction or a direction opposite to the predetermined direction by rotating the second drive mechanism 11*a* in the predetermined direction or the direction opposite to the predetermined direction.

The nip roller 10*b* is supported in the inkjet printer so as to be able to alter position in a state in which the rotational axis of the nip roller 10*b* is oriented parallel to the rotational axis of the auxiliary roller 10*a*. Specifically, the nip roller 10*b* is configured so as to be able to move between a position in which the outer circumference of the auxiliary roller 10*a* and the outer circumference of the nip roller 10*b* are in contact with each other (position of the nip roller 10*b* shown by the solid line in FIG. 1A) and a position in which the outer circumference of the auxiliary roller 10*a* and the outer circumference of the nip roller 10*b* are not in contact with each other (position of the nip roller 10*b* shown by the broken line in FIG. 1A). The movement route can be rectilinear, as shown by the arrows on the broken line in FIG. 1A, or can be curvilinear. In addition, a nip roller drive mechanism 11*b* is connected to the nip roller 10*b*, and the nip roller 10*b* is moved to the position shown by the solid line and the position shown by the broken line in FIG. 1A by the rotation of the nip roller drive mechanism 11*b* in a predetermined direction or a direction opposite to the predetermined direction.

In this case, the position of the nip roller 10*b* shown by the solid line in FIG. 1A is the position at which the outer circumference of the auxiliary roller 10*a* and the outer circumference of the nip roller 10*b* are in contact with each other, as described above, and is a state in which the force directed toward the auxiliary roller 10*a* from the nip roller 10*b* is applied by the nip roller drive mechanism 11*b*. Therefore, the print medium P can be conveyed in this state from the upstream to the downstream on the conveying route, or in the reverse direction from the downstream to the upstream, by rotating the auxiliary roller 10*a* in a predetermined direction or a direction opposite to the predetermined direction, with the print medium P held between the auxiliary roller 10*a* and the nip roller 10*b*. Here, the state in which the print medium P is held between the auxiliary roller 10*a* and the nip roller 10*b* as described above is referred to as the "nip state."

On the other hand, the position of the nip roller 10*b* shown by the broken line in FIG. 1A is a position in which the outer circumference of the auxiliary roller 10*a* and the outer circumference of the nip roller 10*b* are not in contact with each other, as described above, and is therefore a state in which the print medium P is not held between the auxiliary roller 10*a* and the nip roller 10*b* (pressure is not exerted on the medium) in a state in which the print medium P is present between the auxiliary roller 10*a* and the nip roller 10*b*. Here, the state in which the print medium P is not held between the auxiliary roller 10*a* and the nip roller 10*b* is referred to as the "nip-release state." In the present embodiment, the auxiliary roller 10*a*, the nip roller 10*b*, the second driving mechanism 11*a*, and the nip roller drive mechanism 11*b* can implement the nip state and the nip-release state, and correspond to the first conveying mechanism for conveying the print medium P in the nip state, as described above.

In the nip state of the first conveying mechanism, force directed toward the auxiliary roller 10*a* from the nip roller 10*b* is applied by the nip roller drive mechanism 11*b*, as described above, and the ink can therefore be transferred onto the nip roller 10*b* in a case in which the ink printed on the print medium P in the nip state is not dried. In contrast, the roller element 20 is positioned farthest upstream on the conveying route of the print medium P. Ink drying is therefore facilitated while the print medium P is conveyed to the roller element 20 and the ink is not transferred to the print medium P even when the printed print medium P is wound on the roller element 20.

Moreover, in the nip state of the first conveying mechanism, force directed toward the auxiliary roller 10*a* from the nip roller 10*b* is applied by the nip roller drive mechanism 11*b*, but in the second conveying mechanism, the force applied to the print medium P accumulated in a roll shape is mainly force directed in the longitudinal direction (circumferential direction of the roll) of the print medium P in a state in which the first drive mechanism 21 is driven and the print medium P is wound up by the roller element 20. Accordingly, the pressure applied to the print surface (the surface disposed facing the print head 30 and parallel to the platen 50 in a state in which the print medium P is present between the print head 30 and the platen 50) of the print medium P in the nip state of the first conveying mechanism is higher than the pressure applied to the print surface of the print medium P in a case in which the print medium P is conveyed by the second conveying mechanism. The ink is therefore more easily transferred onto the nip roller 10*b* and is less likely to be transferred onto the roller element 20 in a case in which the ink printed on the print medium P is not dried in the nip state.

The inkjet printer according to the present embodiment is provided with the heater 60, as described above. Therefore, the ink on the printed section is dried when a predetermined time period has elapsed in a state in which printing is performed on the print medium P, and the printed print medium P is then heated by the heater 60. However, a configuration also exists in which white ink is first printed, the print medium P is then reversed and conveyed along the conveying route, and color ink is again printed on the print medium P, as described above. If a configuration is adopted in which drying of the white ink is awaited, the print medium P must be reversed and conveyed after a standby period in which a predetermined time period elapses from the timing at which the white ink is last printed on the print area of the print medium P. Accordingly, printing cannot be performed at high speeds.

In view of this, a configuration is adopted in the present embodiment in which the nip-release state is used and no white ink is transferred even if the print medium P is reversed and conveyed before the predetermined time period has elapsed from the timing at which the white ink is last printed, and in which printing can be performed at high speeds. The inkjet printer according to the present embodiment is provided with a controller 70, as shown in FIG. 1B; and the print head 30, the reference position detection sensor 40, the heater 60, the second drive mechanism 11*a*, the nip roller drive mechanism 11*b*, and the first drive mechanism 21 are connected to the controller 70 by an interface (not shown). The controller 70 outputs control signals to various units to control these units, allowing printing to be performed by the print head 30 while the print medium P is being conveyed. In this configuration, the controller 70 performs printing in accordance with the flowchart shown in FIG. 2, whereby the rollers and the conveying timing are controlled and printing is performed so that no white ink is transferred even if the print medium P is reversed and conveyed before the predetermined time period has elapsed from the timing at which the white ink was last printed. Accordingly, the controller 70 in the present embodiment constitutes the conveyance controller.

(2) Printing Process

Figure 2:
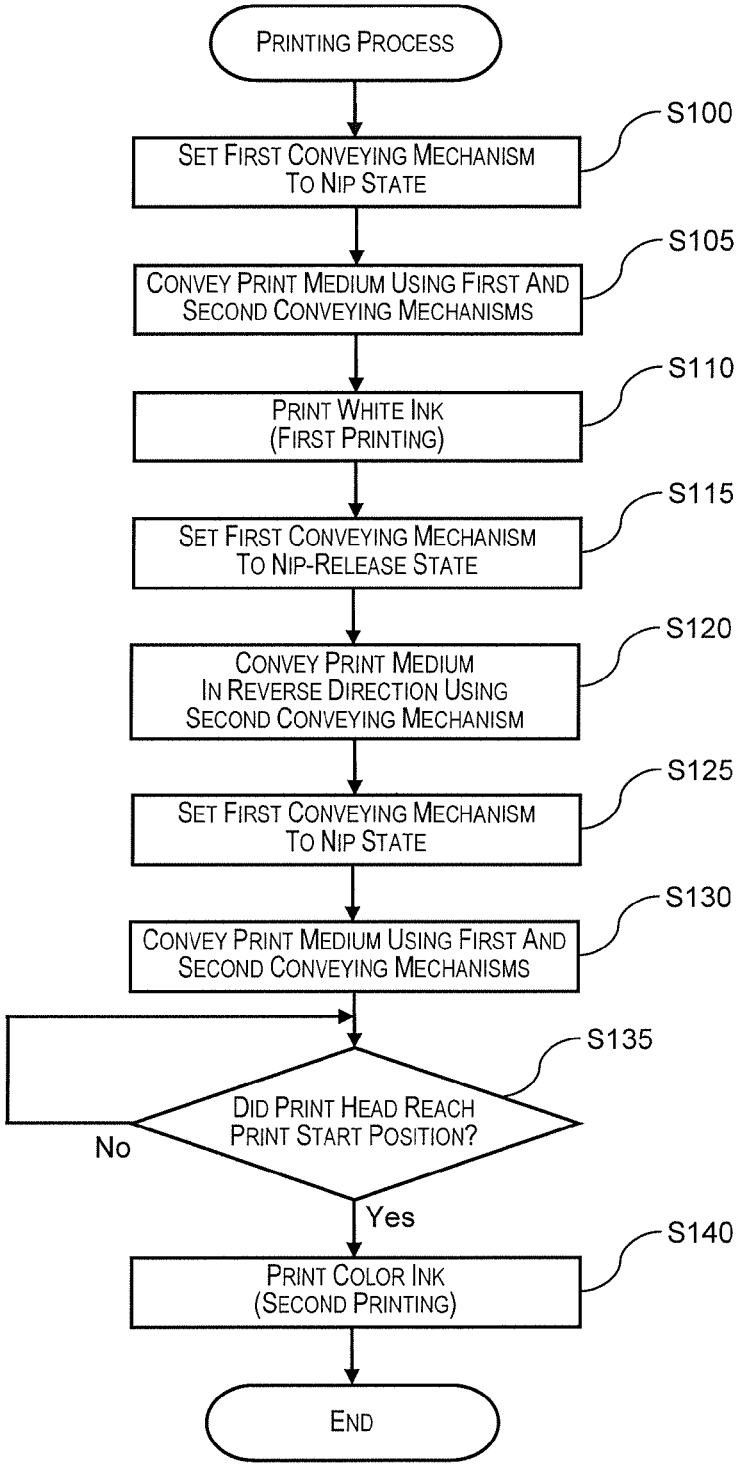
FIG. 2 is a flowchart of the printing process.

In the printing process shown in FIG. 2, the controller 70 first sets the first conveying mechanism to the nip state (step S100). Specifically, the controller 70 outputs a control signal to the nip roller drive mechanism 11*b* to drive the nip roller drive mechanism 11*b*, and causes the nip roller 10*b* to move to a position, such as the one shown by the solid line in FIG. 1A, at which the outer circumference of the auxiliary roller 10*a* and the outer circumference of the nip roller 10*b* are in contact with each other. It is apparent that a configuration can also be adopted so that the nip state occurs after the print medium P is conveyed between the auxiliary roller 10*a* and the nip roller 10*b*.

The controller 70 then conveys the print medium P using the first conveying mechanism and the second conveying mechanism (step S105). Specifically, the controller 70 outputs control signals to the second drive mechanism 11*a* and the first drive mechanism 21 to rotatably drive the second drive mechanism 11*a* and the first drive mechanism 21 in a predetermined direction, pay out the print medium P by the rotation of the roller element 20 in a predetermined direction, and convey the print medium P from upstream to downstream by the rotation of the auxiliary roller 10*a* in a predetermined direction.

The controller 70 then prints white ink (first printing: step S110). Specifically, the controller 70 outputs control signals to the first drive mechanism 11*a*, the second drive mechanism 21, and the print head 30 to convey the print medium P at the same timing as when the ink is discharged from the print head 30, and to discharge white ink from the print head 30 in accordance with the print data showing an image of the object to be printed.

The controller 70 records the relationship between the reference position on the print medium P and the print start position based on the print head 30 when printing the white ink. Specifically, the controller 70 outputs a control signal to the reference position detection sensor 40, whereby the reference position detection sensor 40 is operated and the reference position on the print medium P is detected based on the signal output by the reference position detection sensor 40. The conveying amount for which the print medium P is conveyed by the first conveying mechanism and the second conveying mechanism after the reference position is detected until the printing of the white ink is started is recorded in RAM (not shown) or the like as information showing the print start position.

The controller 70 then sets the first conveying mechanism to the nip-release state (step S115). Specifically, the controller 70 outputs a control signal to the nip roller drive mechanism 11*b* to drive the nip roller drive mechanism 11*b* and cause the nip roller 10*b* to move to a position, such as the one shown by the broken line in FIG. 1A, in which the outer circumference of the auxiliary roller 10*a* and the outer circumference of the nip roller 10*b* are not in contact with each other. The controller 70 then conveys the print medium in a reverse direction using the second conveying mechanism (step S120). Specifically, the controller 70 outputs a control signal to the first drive mechanism 21 to rotatably drive the first drive mechanism 21 in a direction opposite to a predetermined direction, to wind up the print medium P by rotating the roller element 20 in a direction opposite to the predetermined direction, and to convey the print medium P a predetermined amount from downstream to upstream.

In the present embodiment, steps S115 and S120 are implemented when the white ink has been printed on the section of the print area of the print medium P that was printed last in step S110. Accordingly, the print medium P in the present embodiment is conveyed in a reverse direction before the section on which the white ink was last printed is conveyed downstream for a distance corresponding to the length L of the heater 60 in the direction aligned with the conveying direction. The print medium P is therefore conveyed in the reverse direction in a state in which the predetermined time period has not yet elapsed after the white ink has been printed, but since the nip-release state is set in advance in step S115 in the present embodiment, the print medium P can be conveyed without the transfer of white ink onto the nip roller 10*b* even in a state in which the white ink is not completely fixed to the print medium P.

In step S120, the print medium P is conveyed a predetermined conveying amount in the reverse direction, whereupon the controller 70 sets the first conveying mechanism to the nip state (step S125) to convey the print medium P using the first conveying mechanism and the second conveying mechanism (step S130). In the present embodiment, the print medium P is thus conveyed a predetermined amount from downstream to upstream in step S120, and the nip state is then reestablished in step S125, but in combining the print medium P and the white ink in the present embodiment, the section in which the white ink is last printed on the print area of the print medium P is conveyed from downstream to upstream and dried before again reaching the space between the auxiliary roller 10*a* and the nip roller 10*b*. Accordingly, the print medium P can be conveyed without the transfer of white ink onto the nip roller 10*b* even when step S130 is implemented after the predetermined time period substantially elapses and step S125 is completed while step S120 is being implemented.

In step S130, the conveyance of the print medium P is started, whereupon the controller 70 determines whether or not the print head 30 has reached the print start position (step S135). Specifically, the controller 70 detects the reference position on the print medium P based on the signal output by the reference position detection sensor 40, and then determines whether the print head 30 has reached the print start position in a case in which the print medium P was conveyed the aforementioned conveying amount by the first conveying mechanism and the second conveying mechanism.

The controller 70 returns to step S135 in a case in which it is not determined that the print head 30 has reached the print start position in step S135. On the other hand, the controller 70 prints the color ink in a case in which it is determined that the print head 30 has reached the print start position in step S135 (second printing: step S140). Specifically, the controller 70 outputs control signals to the second drive mechanism 11*a*, the first drive mechanism 21, and the print head 30 to convey the print medium P at a timing synchronized with the discharge of ink from the print head 30, and to discharge the color ink from the print head 30 in accordance with the print data showing an image of the object to be printed. In the present embodiment, the print start positions for the white and color inks are thus made to match each other, making it possible to prevent a discrepancy in the print position between the printing of white ink and the printing of color ink, and to perform printing at a high quality.

(3) Other Embodiments

The above-described embodiment is one example of working the invention, and various other embodiments can be adopted as long as the first conveying mechanism is set to the nip-release state in a case in which the print medium for which the predetermined time period has not yet elapsed is conveyed after printing. For example, the printer can be provided with at least a first conveying mechanism and a second conveying mechanism, and can certainly be provided with another conveying mechanism other than the first conveying mechanism and the second conveying mechanism.

Furthermore, the timing for changing the nip-release state to the nip state should be one at which there is no ink transfer, and a configuration can be adopted in which a standby period is provided to ensure a time period for the ink to dry (for the predetermined time period to elapse after printing) if the ink is not dried by the stage in which conveyance is completed in step S120 and the print medium again reaches the space between the auxiliary roller 10*a* and the nip roller 10*b*. In addition, the printer can be configured without being provided with the heater 60, in which case the predetermined time period corresponds to the time period that follows printing by the print head 30 and extends to the state in which the ink has dried and cannot be transferred to other components.

What is claimed is:

1. A printer comprising:

a head configured to perform printing on a print medium;

a roll element on which the print medium is wound in a roll shape;

a first drive mechanism capable of conveying the print medium by rotating the roll element and paying out the print medium in a forward direction, and of conveying the print medium by rotating the roll element and winding up the print medium in a reverse direction;

an auxiliary roller positioned between the head and the roll element, the auxiliary roller assisting in the conveyance of the print medium;

a second drive mechanism configured to rotate the auxiliary roller and convey the print medium;

a nip roller constituting a pair with the auxiliary roller to hold the print medium on both sides;

a nip roller drive mechanism capable of moving the nip roller and creating a first state in which the print medium is held on both sides, and a second state in which the print medium is not held on both sides; and a controller configured to control the head, the first drive mechanism, the second drive mechanism, and the nip roller drive mechanism to perform the printing and conveying the print medium, the printing including a first printing and a second printing that is performed subsequent to the first printing, the first printing being performed on the print medium by the head while the print medium is conveyed in the forward direction, the second printing being performed on the print medium by the head while the print medium is conveyed in the forward direction after the print medium on which the first printing is performed has been conveyed in the reverse direction, the controller controlling the nip roller drive mechanism to set the nip roller to the first state in a case where the first drive mechanism conveys the print medium by paying out the print medium from the roll element in the forward direction, and to set the nip roller to the second state in a case where the first conveying mechanism winds up the print medium onto the roll element in the reverse direction after the first printing on the print medium has been performed by the head, the controller controlling the nip roller drive mechanism to set the nip roller to change from the first state to the second state, in response to finishing the first printing on the print medium that the first drive mechanism conveys in the forward direction, before the first drive mechanism coveys the print medium in the reverse direction such that the second printing is performed.

2. The printer according to claim 1, wherein the controller controls conveying the print medium by paying out the print medium using the first drive mechanism while the nip roller is in the first state, discharging white ink from the head and performing the first printing on the print medium, conveying the print medium by winding up the print medium using the first drive mechanism while the nip roller is in the second state, conveying the print medium by again paying out the print medium using the first drive mechanism while the nip roller is in the first state, and discharging color ink from the head and performing the second printing on the print medium.

3. The printer according to claim 2, further comprising a reference position detection sensor for detecting a reference position on the print medium; wherein the controller controls the head such that a match is established in the first printing and the second printing for the relationship between the reference position detected by the reference position detection sensor and a print start position on the print medium.

4. The printer according to claim 2, wherein the controller further controls conveying the print medium by winding up the print medium using the first drive mechanism while the nip roller is in the second state, and conveying the print medium by winding up the print medium using the first drive mechanism while the nip roller is in the first state after a predetermined time period has elapsed.

5. The printer according to claim 4, further comprising a heater disposed downstream of the head, wherein the predetermined time period is a time period occurring before the ink printed on the print medium is dried by the heater.

* * * * *